United States Patent [19]

Richeson, Jr.

[11] Patent Number: 4,974,495

[45] Date of Patent: Dec. 4, 1990

[54] ELECTRO-HYDRAULIC VALVE ACTUATOR

[75] Inventor: William E. Richeson, Jr., Fort Wayne, Ind.

[73] Assignee: Magnavox Government and Industrial Electronics Company, Fort Wayne, Ind.

[21] Appl. No.: 457,015

[22] Filed: Dec. 26, 1989

[51] Int. Cl.[5] ..... F15B 13/044

[52] U.S. Cl. ..... 91/459; 60/329; 91/466; 123/90.11; 123/90.12; 137/625.65; 251/30.05; 251/129.1

[58] Field of Search ..... 60/329; 91/459, 466; 137/625.65; 251/30.05, 129.1; 123/90.11, 90.12, 90.13, 90.14

[56] References Cited

U.S. PATENT DOCUMENTS

| | | | |
|---|---|---|---|
| 3,738,337 | 6/1973 | Massie | 123/90.12 |
| 4,253,493 | 3/1981 | English | 137/628.65 X |
| 4,749,167 | 6/1988 | Gottschall | 251/129.1 X |
| 4,852,528 | 8/1989 | Richeson et al. | 123/90.11 |
| 4,872,425 | 10/1989 | Richeson et al. | 123/90.13 |
| 4,873,948 | 10/1989 | Richeson et al. | 137/90.11 |
| 4,875,441 | 10/1989 | Richeson et al. | 123/90.13 |
| 4,878,464 | 11/1989 | Richeson et al. | 123/90.11 |

*Primary Examiner*—Gerald A. Michalsky

*Attorney, Agent, or Firm*—Roger M. Rickert; Thomas A. Briody; Richard T. Seeger

[57] ABSTRACT

A fast acting valve actuator for actuating an intake or exhaust valve in an internal combustion engine of a type which is hydraulically powered and command triggered is disclosed and includes a cylinder with a power piston having a pair of opposed working surfaces or faces reciprocable within the cylinder along an axis between first and second extreme positions. A cylindrical control valve is located radially intermediate the reservoir and the cylinder, and is movable upon command to alternately supply high pressure fluid from a reservoir of high pressure hydraulic fluid to one face and then the other face of the power piston causing the piston to move from one extreme position to the other extreme position. The cylindrical control valve may be a shuttle valve which is reciprocable along the axis of the power piston between extreme positions with control valve motion along the axis in one direction being effective to supply high pressure fluid to move the piston in the opposite direction. Both the control valve and the piston are stable in both of their respective extreme positions and the control valve is spring biased toward a position intermediate the extreme positions. The latter portion of piston motion during one operation of the valve actuator is effective to cock this spring and bias the control valve preparatory to the next operation.

19 Claims, 12 Drawing Sheets

ELECTRO-HYDRAULIC VALVE ACTUATOR

SUMMARY OF THE INVENTION

The present invention relates generally to a two position, bistable, straight line motion actuator and more particularly to a fast acting actuator which utilizes fluid pressure against a piston to perform fast transit times between the two positions. The invention utilizes a control valve to gate high pressure fluid to the piston and permanent magnets to hold the control valve in either of two positions until the appropriate one of two coils is energized to neutralize the permanent magnet latching force and, with the aid of energy stored in a stressed spring during the previous transition, to move the valve from one position to the other.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves. The actuator mechanism may find numerous other applications.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

For example, in U.S. patent application Ser. No. 226,418 entitled VEHICLE MANAGEMENT COMPUTER filed in the name of William E. Richeson on July 29, 1988 there is disclosed a computer control system which receives a plurality of engine operation sensor inputs and in turn controls a plurality of engine operating parameters including ignition timing and the time in each cycle of the opening and closing of the intake and exhaust valves among others. This application teaches numerous operating modes or cycles in addition to the conventional four-stroke cycle.

U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

U.S. Pat. No. 4,700,684 ≠suggests that if freely adjustable opening and closing times for inlet and exhaust valves is available, then unthrottled load control is achievable by controlling exhaust gas retention within the cylinders.

Substitutes for or improvements on conventional cam actuated valves have long been a goal. In my U.S. Pat. No. 4,794,890 entitled ELECTROMAGNETIC VALVE ACTUATOR, there is disclosed a valve actuator which has permanent magnet latching at the open and closed positions. Electromagnetic repulsion may be employed to cause the valve to move from one position to the other. Several damping and energy recovery schemes are also included.

In application Ser. No. 153,257, entitled PNEUMATIC ELECTRONIC VALVE ACTUATOR, filed Feb. 8, 1988 now U.S. Pat. No. 4,878,464 in the names of William E. Richeson and Frederick L. Erickson and assigned to the assignee of the present application there is disclosed a somewhat similar valve actuating device which employs a release type mechanism rather than a repulsion scheme as in the previously identified copending application. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not. This copending application also discloses different operating modes including delayed intake valve closure and a six stroke cycle mode of operation.

The forgoing as well as a number of other related applications all assigned to the assignee of the present invention and filed in the name of William E. Richeson or William E. Richeson and Frederick L. Erickson are summarized in the introductory portions of Ser. No. 07/294,728 filed in the names of Richeson and Erickson on Jan. 6, 1989 now U.S. Pat. No. 4,875,441, and entitled ENHANCED EFFICIENCY VALVE ACTUATOR.

Many of the later filed above noted cases have a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by an electrical pulse in a coil near the permanent magnet.

The entire disclosures of all of the above identified copending applications are specifically incorporated herein by reference.

Other types of fluid powered valve actuators have been suggested in the literature, but have not met with much commercial success because, among other things, it is difficult and time consuming to move a large quantity of hydraulic fluid through a pipe or conduit of a significant length (more precisely, long in comparison to its cross-section). Hence, systems with lengthy connections are also plagued by lengthy response times.

For example, U.S. Pat. No. 4,791,895 discloses an engine valve actuating mechanism where an electromagnetic arrangement drives a first reciprocable piston and the motion of that piston is transmitted through a pair of pipes to a second piston which directly drives the valve stem. This system employs the hydraulic analog of a simple first class lever to transmit electromagnet generated motion to the engine valve. U.S. Pat. No. 3,209,737 discloses a similar system, but actuated by a rotating cam rather than the electromagnet.

U.S. Pat. No. 3,548,793 employs electromagnetic actuation of a conventional spool valve in controlling hydraulic fluid to extend or retract push rods in a rocker type valve actuating system.

U.S. Pat. No. 4,000,756 discloses another electro-hydraulic system for engine valve actuation where relatively small hydraulic poppet type control valves are held closed against fluid pressure by electromagnets and the electromagnets selectively deenergized to permit the flow of fluid to and the operation of the main engine valve.

In the present application, a relatively constant high pressure source is maintained close to the piston faces which are to be actuated and the fluid ducting and valving path therebetween has a very high ratio of cross-section to length. This makes the valve very fast acting and significantly reduces losses as compared to conventional hydraulic systems.

Among the several objects of the present invention may be noted the provision of a fast acting hydraulically powered actuator; the provision of a small volume, relatively constant pressure fluid source; the provision of individually removable internal combustion engine intake or exhaust valve and valve actuator units; the provision of an electronically controllable, hydraulically powered transducer; and overall improvements in hydraulic technology by reduction of fluid path lengths and increase in fluid path cross-sections thereby facilitating the transfer of comparatively large amounts of fluid in a relatively short time. These as well as other objects and advantageous features of the present invention will be in part apparent and in part pointed out hereinafter.

In general, an electrically controlled hydraulically powered valve actuator has a valve actuator housing with a power piston reciprocable within the housing along an axis and a bistable hydraulic fluid control valve which is also reciprocable along that axis relative to both the housing and the piston between first and second extreme stable positions. Movement of the control valve in one direction from one stable position to the other stable position provides hydraulic fluid to the power piston causing the power piston to move in the opposite direction. The control valve is in turn controlled by a pair of permanent magnets and a corresponding pair of coils with each coil being energizable to at least partially neutralize the magnetic field of the associated permanent magnet and comprises a cylindrical sleeve coaxial with and at least partially surrounding the piston, and an armature joined to the sleeve and responsive to magnetic fields to retain the control valve in either stable position. The control valve is magnetically latched in each of its stable positions and a spring for urging the control valve away from the stable position in which it is latched is cocked by piston movement during the previous operation of the valve preparatory to a subsequent operation.

Also in general and according to one aspect of the invention, a low volume constant pressure source of high pressure fluid is created using a cylinder with a pair of spaced apart pistons spring biased toward one another and a remote high pressure source coupled to the space intermediate the pistons. An end use device such as an internal combustion engine intake or exhaust valve actuator is driven by intermittently delivering high pressure fluid from the space intermediate the pistons whereby the pistons collapse toward one another due to the spring bias while maintaining the fluid pressure as fluid exits the space. The action of the pistons collapsing toward one another also creates an increasing volume behind them so as to readily absorb the exhaust fluid from the actuator cylinder. While much of the prior art discussed earlier utilized air or other gaseous material as the working medium, the present invention contemplates a hydraulic fluid which as is well known is substantially incompressible. This incompressibility is compensated for by the "compressibility" of the pistons. Thus despite fluid being removed, the pressure is not appreciably diminished.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
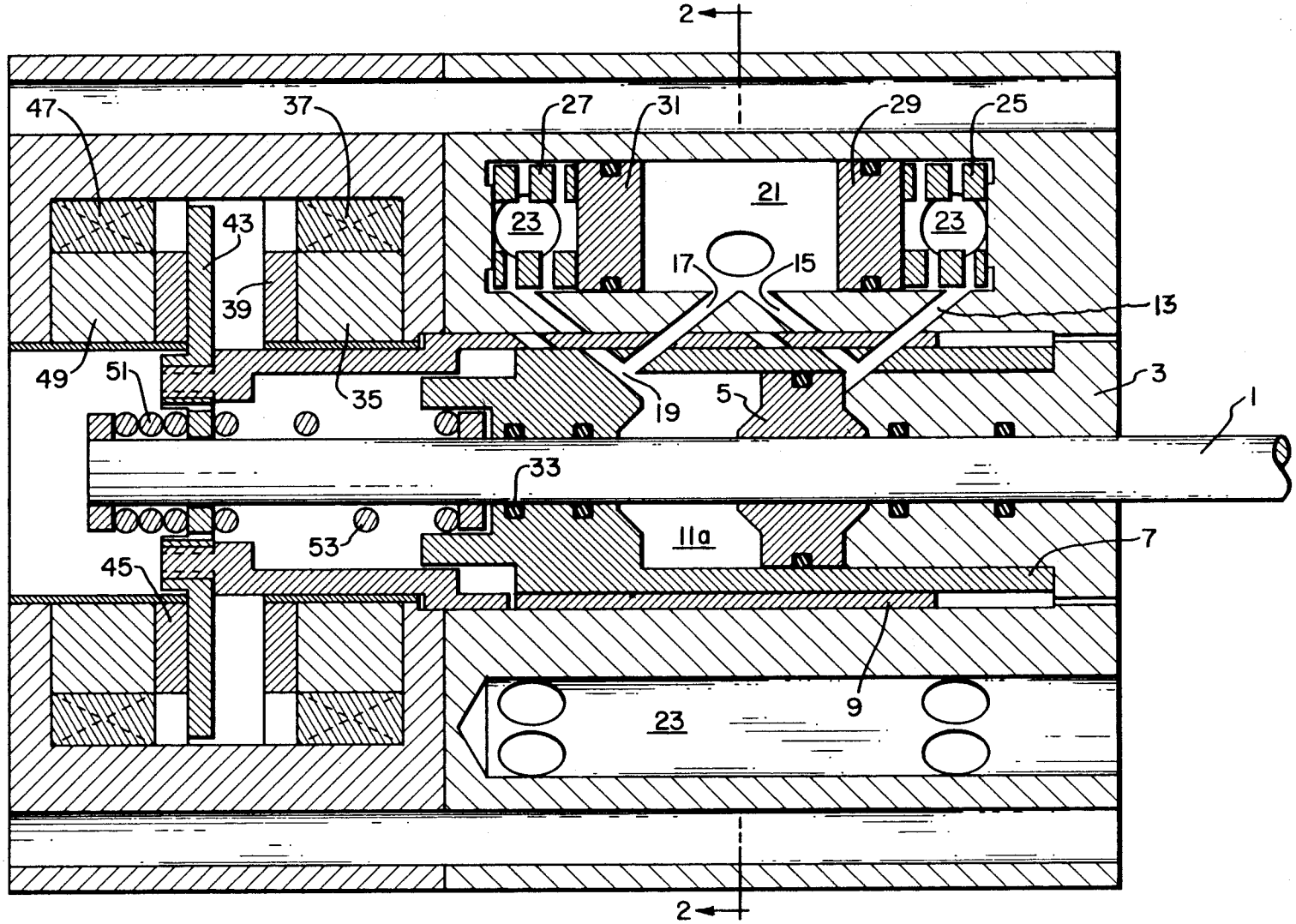
FIG. 1 is a view in cross-section of the upper left quadrant (as seen in FIG. 2) of a hydraulic valve actuator illustrating the present invention in one form.
Figure 2:
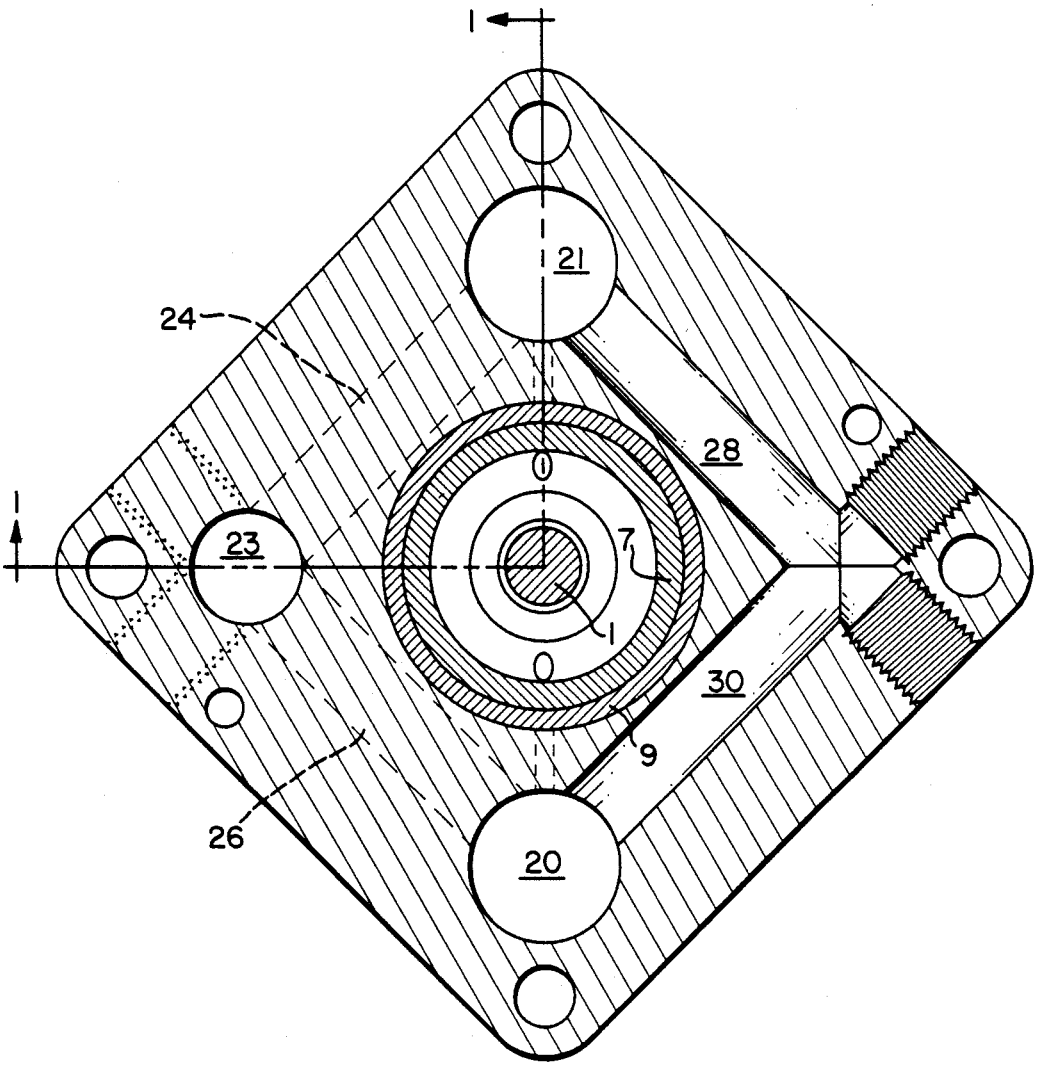
FIG. 2 is an end cross-sectional view of the hydraulic valve actuator along line 2 of FIG. 1 and showing the quadrant section line 1—1 for FIG. 1.

FIG. 1 shows the first quadrant of the hydraulic valve actuator shown in FIG. 2 folded ninety degrees. FIG. 1 consist of a shaft 1 coupled with a piston 5 in a cylinder 11 made up by sleeve 7 surrounded by valve 9 in main body 3. Cylinder 11 communicates with high pressure cylinder 21 through ports 17 and 15; also cylinder 11 communicates with low pressure cylinder 23 through ports 13 and 19. High pressure cylinder 21 is made up by main body 3 and has pistons 29 and 31 which are coupled to springs 25 and 27 respectively. Seals 33 are used to insure no leakage of fluid.

Figure 3:
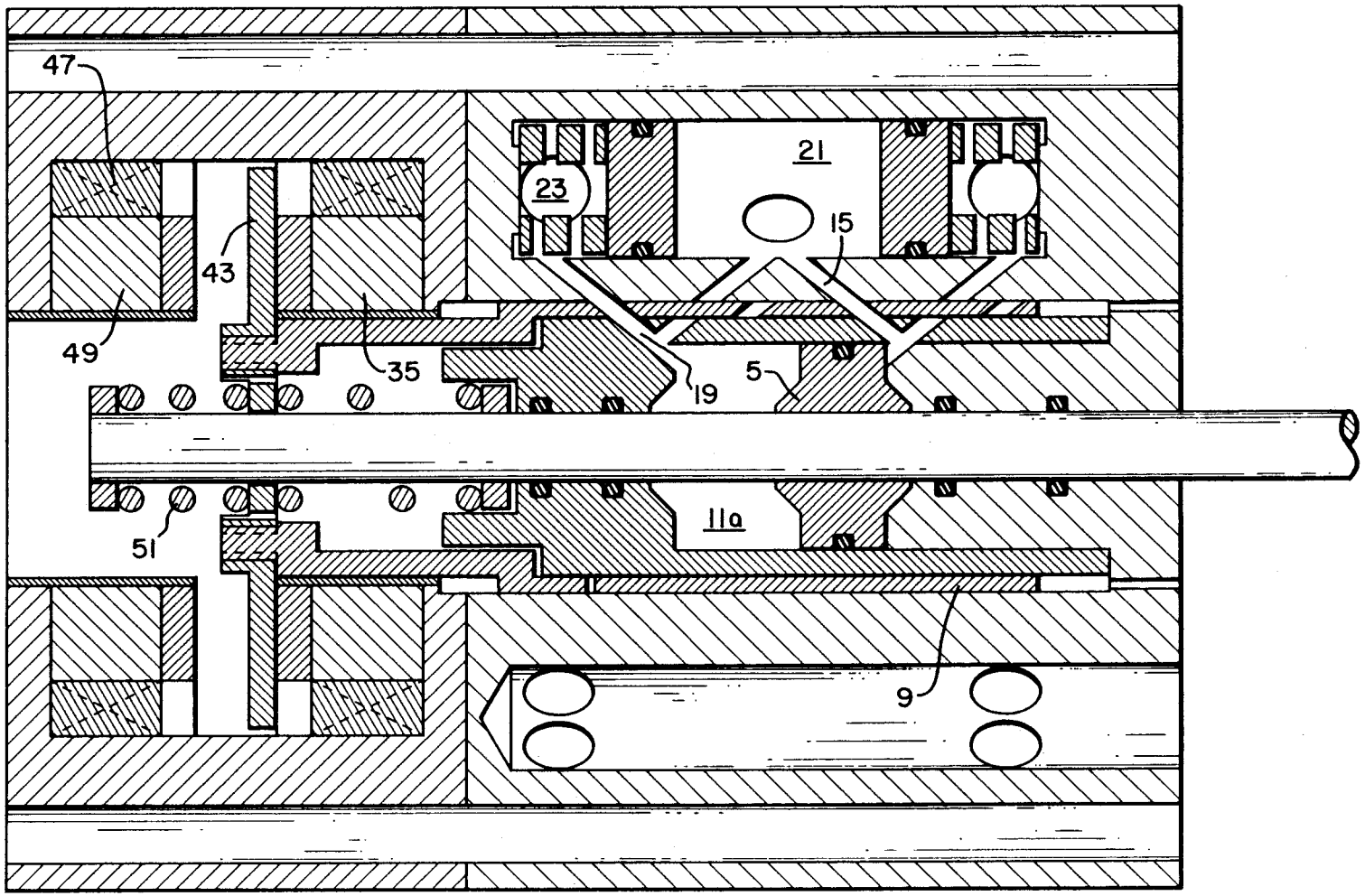
FIGS. 3–5, 8 and 9 are views identical to FIG. 1, but sequentially illustrating the various parts as the valve moves from one stable location to the other and then returns to the original stable location.

The hydraulic valve actuator is an electronically controlled hydraulically powered valve actuator or transducer and includes a constant pressure source of high pressure fluid built around the pistons 29 and 31 and compression springs 27 and 25. The constant pressure source comprises a cylinder with the pair of spaced apart pistons 29 and 31 spring biased toward one another. A high pressure galley 22 is fed from a remote high pressure source (79 of FIGS. 11 and 12) and is coupled to the space intermediate the pistons and an arrangement including the bistable hydraulic fluid control valve 9 intermittently delivers high pressure fluid from the space intermediate the pistons and the pistons collapse toward one another due to the spring bias while maintaining the fluid pressure in chamber 21 as fluid exits the space. As the pistons collapse toward each other, their opposite sides create increasing volumes which act as sinks for the low pressure exhaust from the actuator. FIG. 3 shows a low pressure galley which is a return line to the external source.

Generally speaking, the hydraulically actuated transducer has a transducer housing or main body 3 and a member or working piston 5 reciprocable within the housing along an axis. The piston has a pair of opposed primary working surfaces which define chambers 11*a* and 11*b* and receive hydraulic fluid pressure for moving the piston along the axis. A high pressure hydraulic fluid source 21 selectively supplies fluid to the piston faces under the control of a bistable hydraulic fluid control valve 9. Valve 9 is a shuttle valve reciprocable along the same axis as the piston and reciprocates relative to both the housing and the reciprocable member between first and second stable positions. An electronic control arrangement selectively actuates the control valve to move from one stable position to the other stable position to enable the flow of high pressure hydraulic fluid to one of the primary working surfaces.

The hydraulic valve actuator uses electronic controlled magnetic latches. The latches consist of permanent magnets 35 and 49, coils 37 and 47, pole pieces 39 and 45; and armature 43. The latches are used to control the valve actuator by transferring armature 43 which is coupled to valve 9. Armature 43 and valve 9 are propelled by springs 51 and 53. When armature 43 and valve 9 are allowed to move, cylinder 11 is opened to high pressure cylinder 21 through either port 15 or 17 depending on the piston orientation; also the opposite side of cylinder 11 is opened to low pressure cylinder 23 through either port 13 or 19.

FIG. 2 shows the hydraulic valve actuator in cross-section where the galleys 28 and 30 that communicate high pressure to cylinder 11 are visible. Galleys 24 and 26 communicate low pressure to cylinder 11. FIG. 1 is the first quadrant of FIG. 2 folded ninety degrees.

In FIG. 1 the piston 5 is shown in the closed right position (which corresponds to the engine valve being open) with the armature 43 and valve 9 closed. FIG. 3 shows the piston in that same closed rightmost position but armature 43 and valve 9 have traveled to their open position. The coil 47 was energized causing a build up of current and an electro-magnetic field that opposes the permanent magnet 49. When the magnetic attraction force decreases enough the cocked spring 51 and the attractive force due to permanent magnet 35 accelerates armature 43 and valve 9 to their closed position. Now cylinder 11*a* is open to cylinder 23 throgh port 19 and the back side (right face) of piston 5 has high pressure fluid exposed to it from cylinder 21 through port 15. The high pressure in cylinder 11*a* begins to flow to cylinder 23 and the high pressure from cylinder 21 is now pressing on the backside of piston 5.

Figure 4:
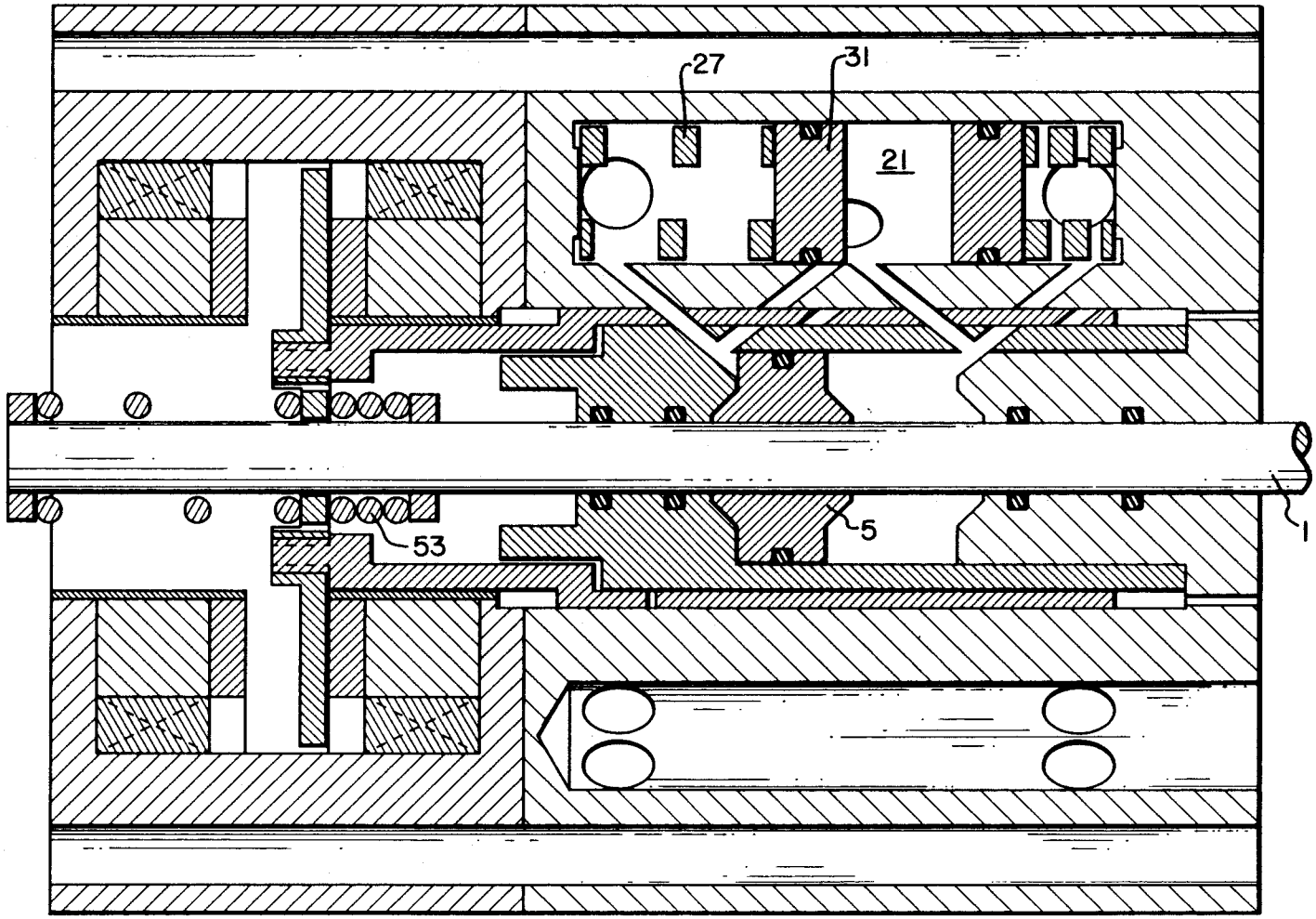

FIG. 4 shows piston 5 in the leftmost position. The high pressure fluid that was in cylinder 11*a* in FIG. 3 has now caused spring 27 to open piston 31. The high pressure fluids from cylinder 21 in FIG. 3 has now caused the piston 5 to travel to its left extreme position. Piston 5 moves very fast but the piston is shaped so that the fluid is compressed in the final thousandths of an inch allowing the valve to be properly damped. Notice also spring 53 has now been compressed by the movement of shaft 1 and is now ready for another transition.

Figure 5:
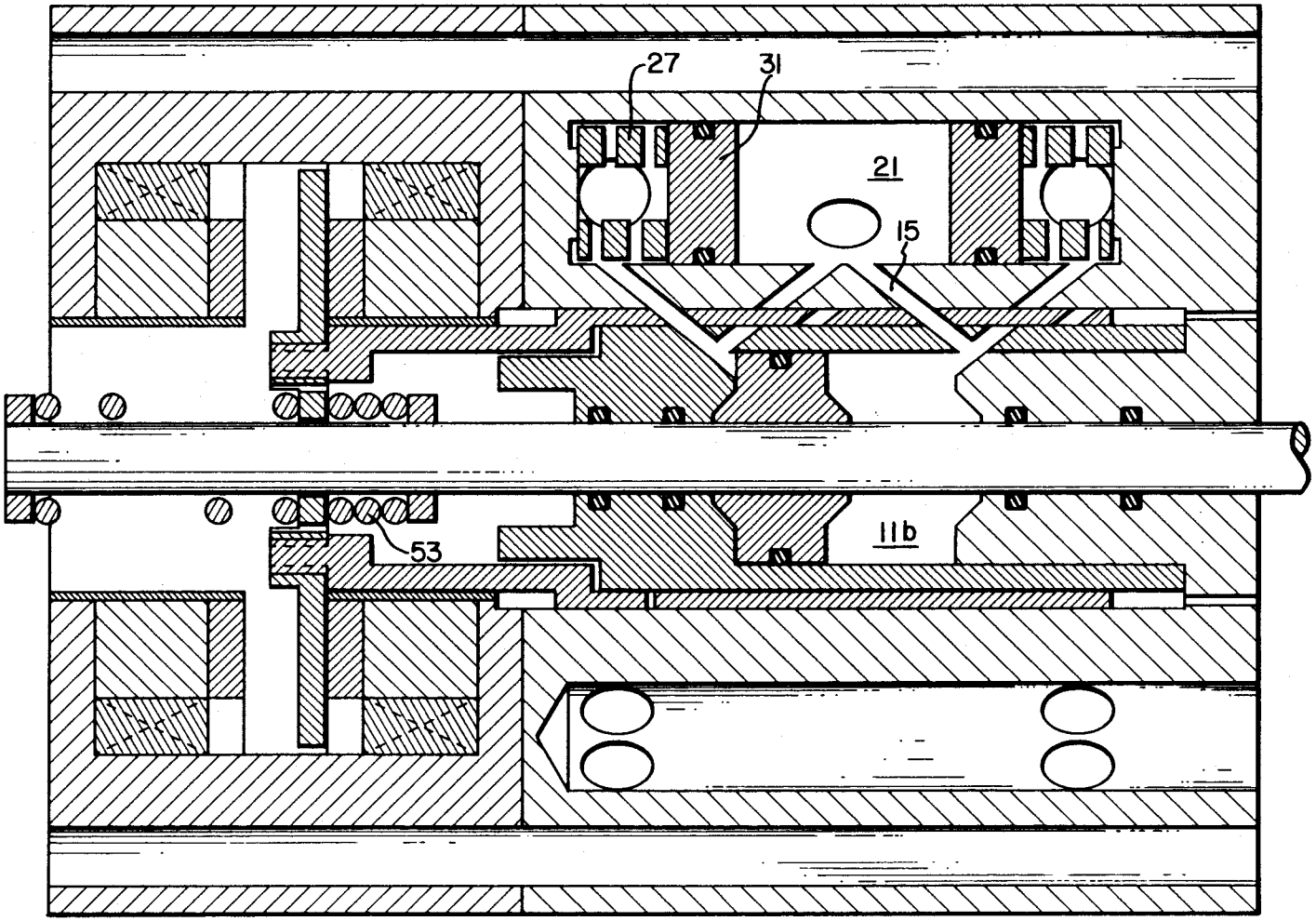

FIG. 5 shows the piston 5 in the left open position with cylinder 11*b* open to cylinder 21 through port 15. In FIG. 4 piston 31 was opened by spring 27 and the high pressure fluid rushing into cylinder 11*b*. In FIG. 3, the low presure fluid in chamber 23 is accepting the fluid from chamber 11*a* so as to additionally allow the motion of piston 5 and piston 31 in FIG. 4 without necessarily requiring immediate flow in the external hydraulic source. After a short time, the external source can recock the system. Now piston 31 has cocked the spring 27 and returned to its closed position through the use of the high pressure fluid in cylinder 21 which is maintained by use of an external pump. Spring 53 is also cocked leaving the actuator ready for another transition.

Figure 6:
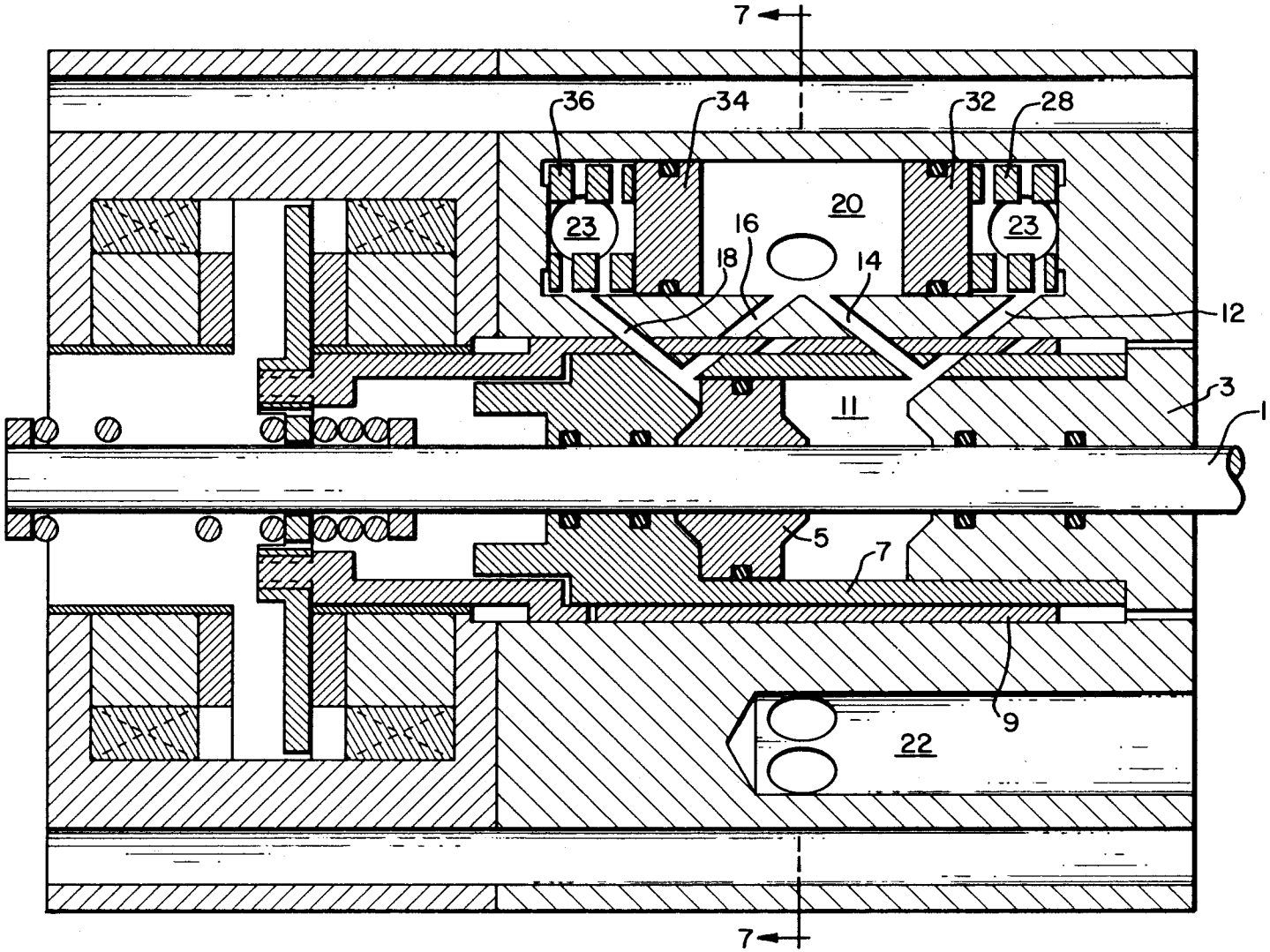
FIG. 6 is a view similar to FIG. 1, but showing the upper right quadrant of FIGS. 2 and 7.
Figure 7:
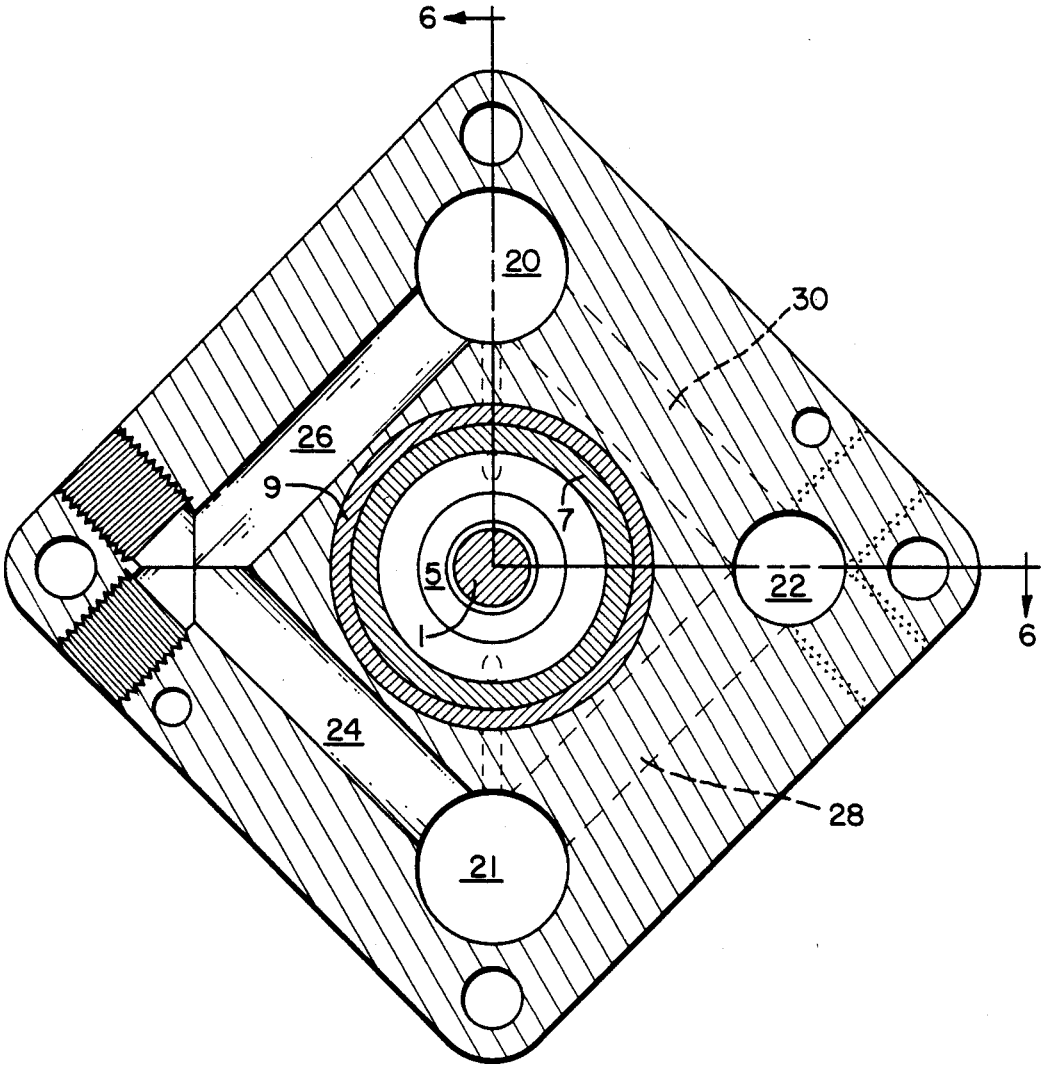
FIG. 7 is a cross-sectional view of the hydraulic valve actuator similar to FIG. 2, but along line 7—7 of FIG. 6 and showing the quadrant section line 6—6 for FIG. 6.

FIG. 6 shows the second quadrant of the hydraulic valve actuator shown in FIG. 7 folded ninety degrees. FIG. 6, like FIGS. 1, and 3–5, shows a shaft 1 coupled with a piston 5 in a cylinder 11 made up by sleeve 7 surrounded by valve 9 in main body 3. Cylinder 11 communicates with high pressure cylinder 20 through ports 16 and 14; also cylinder 11 communicates with low pressure cylinder 23 through ports 12 and 18. Cylinder 20 is made up by main body 3 and has pistons 32 and 34 which are coupled to springs 36 and 38 respectively. The actuator is in the open position just as it was in FIG. 5 the primary difference is, FIG. 6 illustrates the high pressure cylinder 22. The actuator is ready for another transition.

Figure 8:
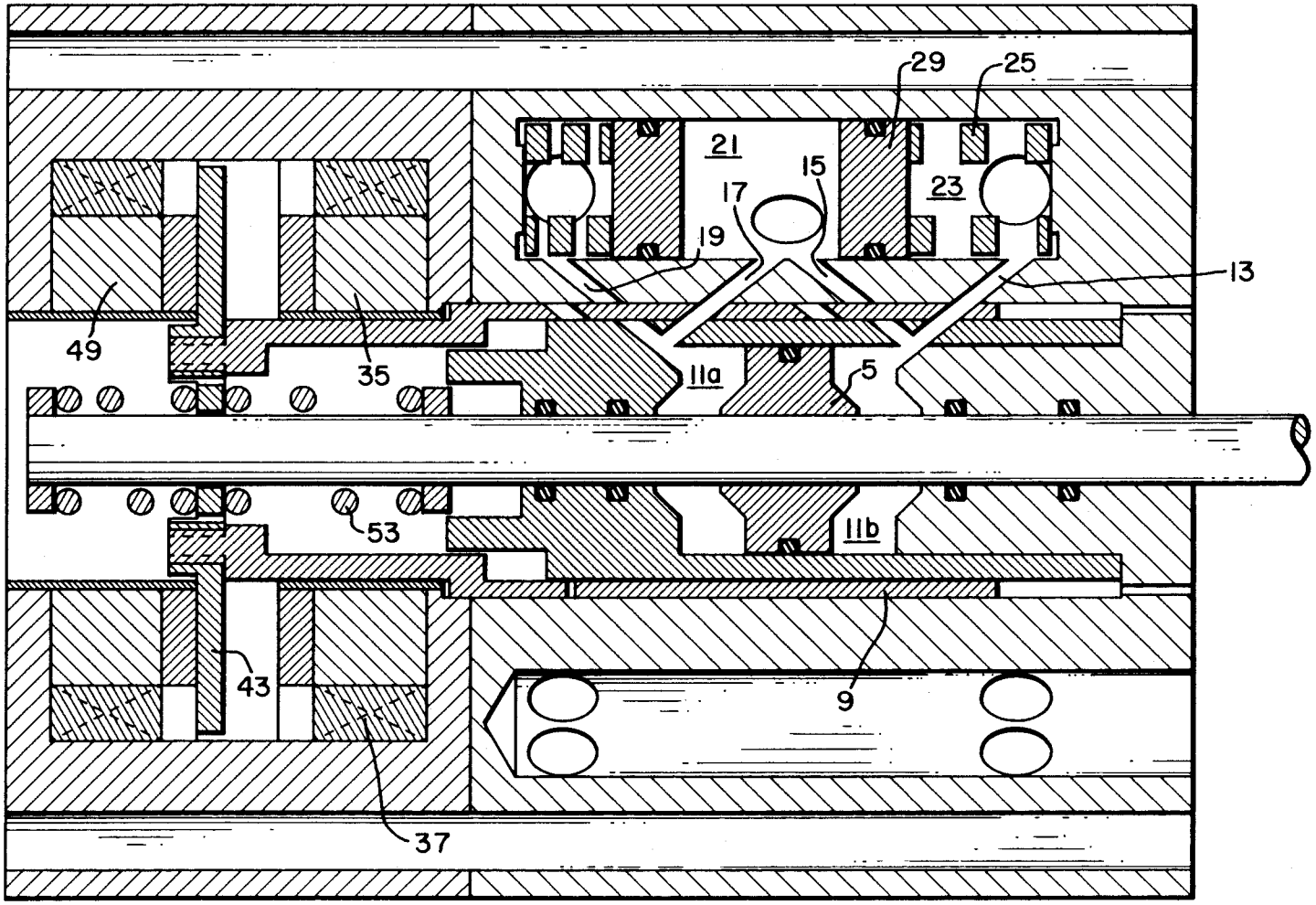
Figure 9:
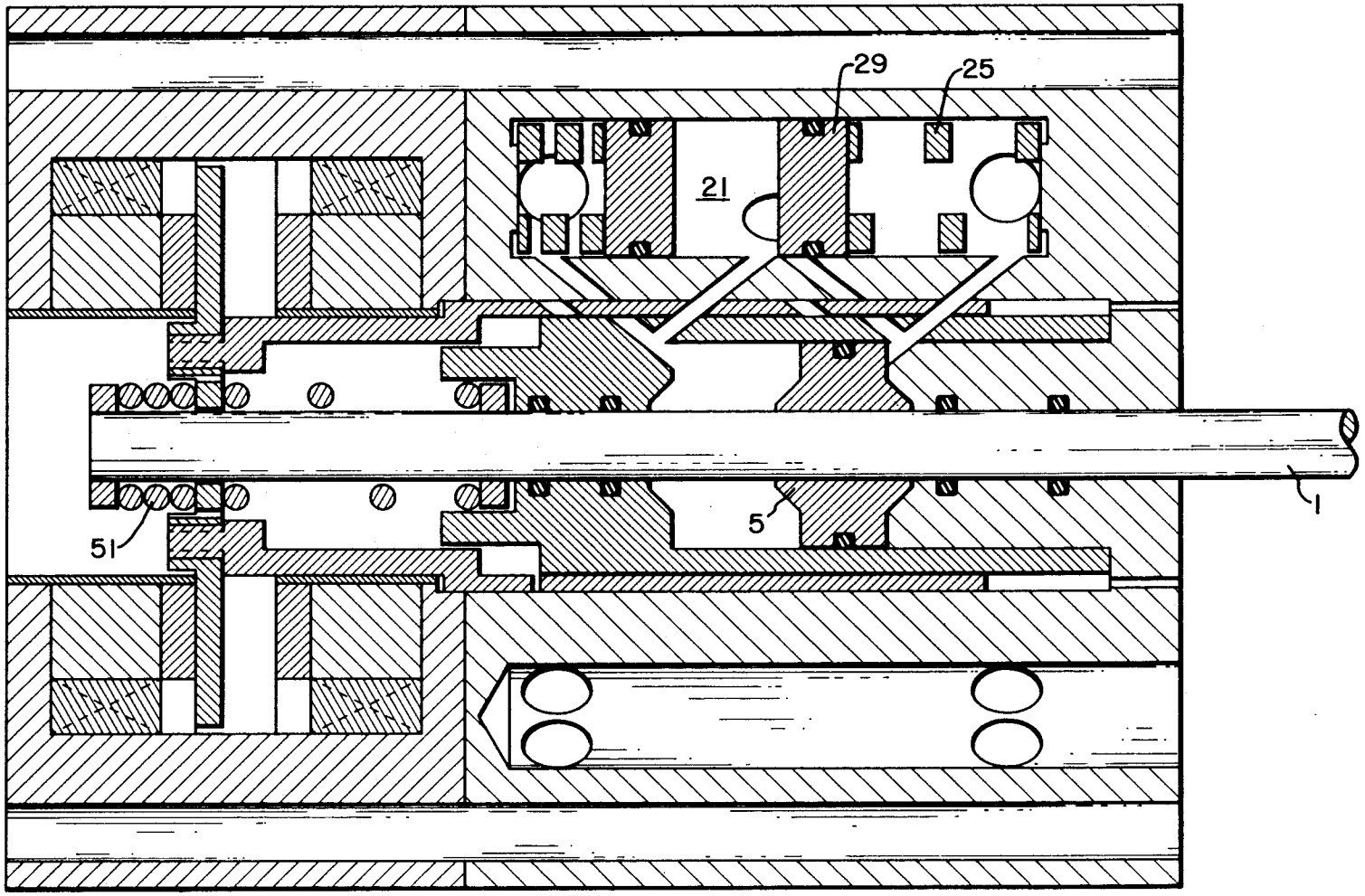
Figure 10:
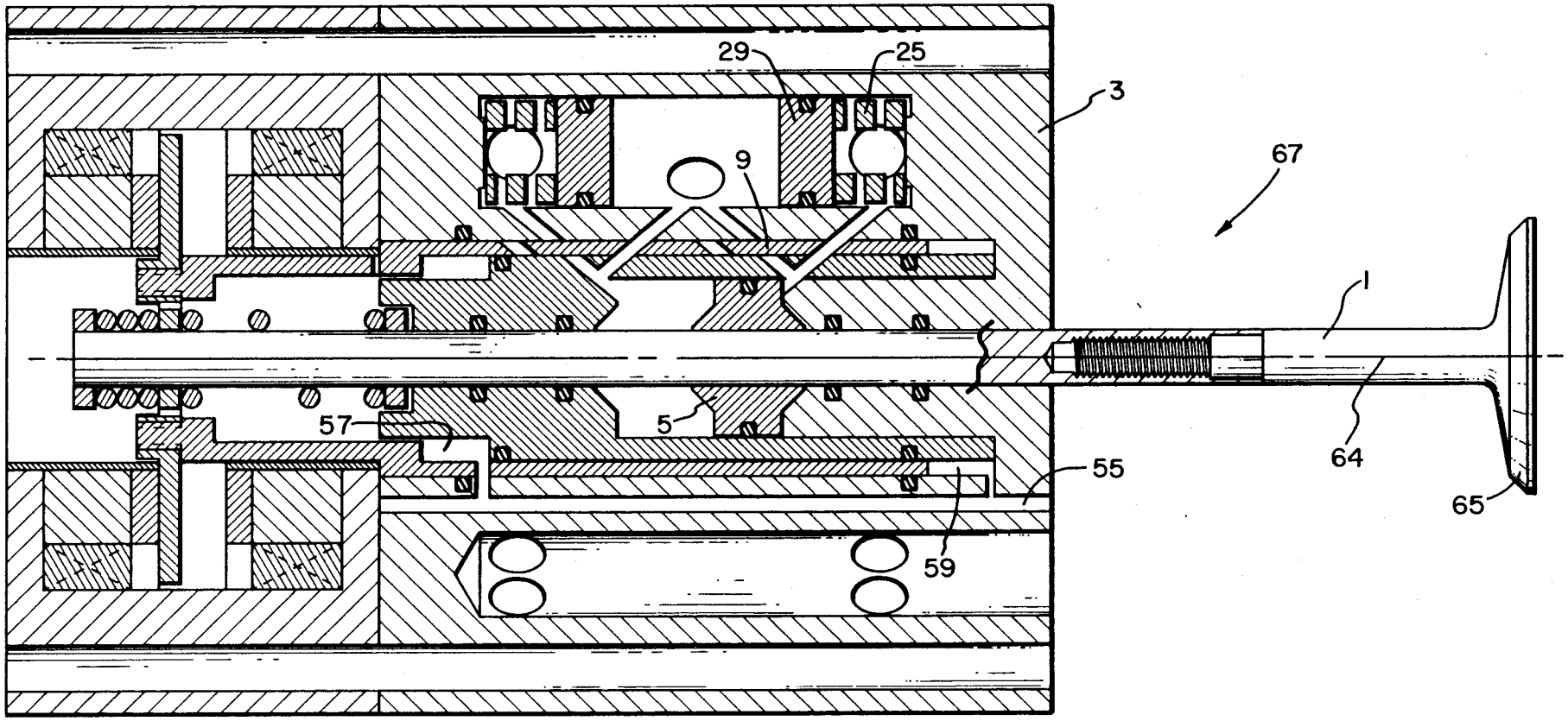
FIG. 10 is a cross-sectional view somewhat like FIG. 1, but showing the valve actuator joined with an illustrative valve.

FIG. 7 shows the hydraulic valve actuator in cross-section along the line 7—7 of FIG. 6. The galleys 28 and 30 that communicate high pressure to cylinder 11 are visible. Galleys 24 and 26 communicate low pressure to cylinder 11. FIG. 6 is the second quadrant of FIG. 7 folded ninety degrees. FIGS. 8–10 return to the first quadrant as shown by lines 1—1 of FIG. 2.

FIG. 8 shows piston 5 in the middle of its transition from open to close. The coil 37 was energized causing a build up of current and an electro-magnetic field that opposes the permanent magnet 35. When the magnetic attraction force decreases enough the cocked spring 53 and the attractive force due to permanent magnet 49 accelerates armature 43 and valve 9 to their closed positions. Ports 19 and 15 have been shut off by valve 9 and cylinder 11*a* now is open to high pressure cylinder 21 through port 17. The high pressure fluid on the left side of main piston 5 accelerates the piston to its right hand extreme position. The fluid on the right side of the main piston in chamber 11*b* rushes through port 13 and into cylinder 23 causing piston 29 to open. Piston 29 is being opened by the heavy spring 25 and the fluid from the right side of main piston 5. In each of the preceding figures, this spring 25 has been maintained in a compression stressed condition by the high pressure in chamber 21. Also, when port 17 is rapidly opened to allow flow from chamber 21 into chamber 11*a*, the left piston 31 can move to the right further closing chamber 21. This condition can exist depending on the pressure drop in chamber 21 and the degree of compression in spring 27. However, this movement will be somewhat smaller than that of piston 29 and is not depicted in FIG. 8.

The cylinders with the opposed spring biased pistons are much like the two faces of Janus. The facing piston surfaces move toward one another to supply high pressure fluid to the actuator while the oppositely facing outer piston surfaces move to expand the end volumes of the cylinder and provide a low resistance fluid sink for fluid exiting the actuator. Thus, the high pressure hydraulic fluid source for powering the valve actuator includes this variable volume chamber which lies closely adjacent the reciprocable member and separated therefrom by the control valve. The variable volume chamber is expanded by high pressure fluid and collapses upon the release of high pressure fluid therefrom to sustain the pressure as fluid flows into the transducer engaging a primary working surface of the piston.

FIG. 9 shows the main piston 5 in its closed (engine valve open) position. The high pressure from cylinder 21 has caused the main piston to travel to this position. The shape of main piston 5 helps to dampen the actuator motion when the piston starts to come to rest. The dampening is due to the shear forces in the captured fluid on the right side of piston 5. These shear forces are caused by the high fluid pressures existing during this period which causes the fluid to exit at high velocities. The spring 51 has also been compressed by the motion of shaft 1. Piston 29 has been fully opened by spring 25 and the fluid from the backside of piston 5 in cylinder 11*b*. The piston will re-cock spring 25 by using the high pressure in cylinder 21 and an external pump.

FIG. 10 is substantially the same as FIG. 9 with the exception that piston 29 and spring 25 have been recocked by an external pump and the extension of main shaft 1 is connected directly to an intake or exhaust valve 65. As shown in FIG. 10, the valve shaft and the actuator shaft are actually two shaft joined by a threaded coupling 63 and sharing axis 64. This facilitates alignment of the valve and valve actuator for the internal combustion engine. The axis 64 along which the power piston 5 reciprocates and the axis (also identified as 64) along which the poppet valve 65 reciprocates are colinear. Also shown in FIG. 10 is Galley 55, which is used to drain the excess fluid accumulated in chambers 57 and 59. The fluid is generated from sliding valve 9. The excess fluid drains into galley 55 and is then returned back to the external pump.

Figure 11:
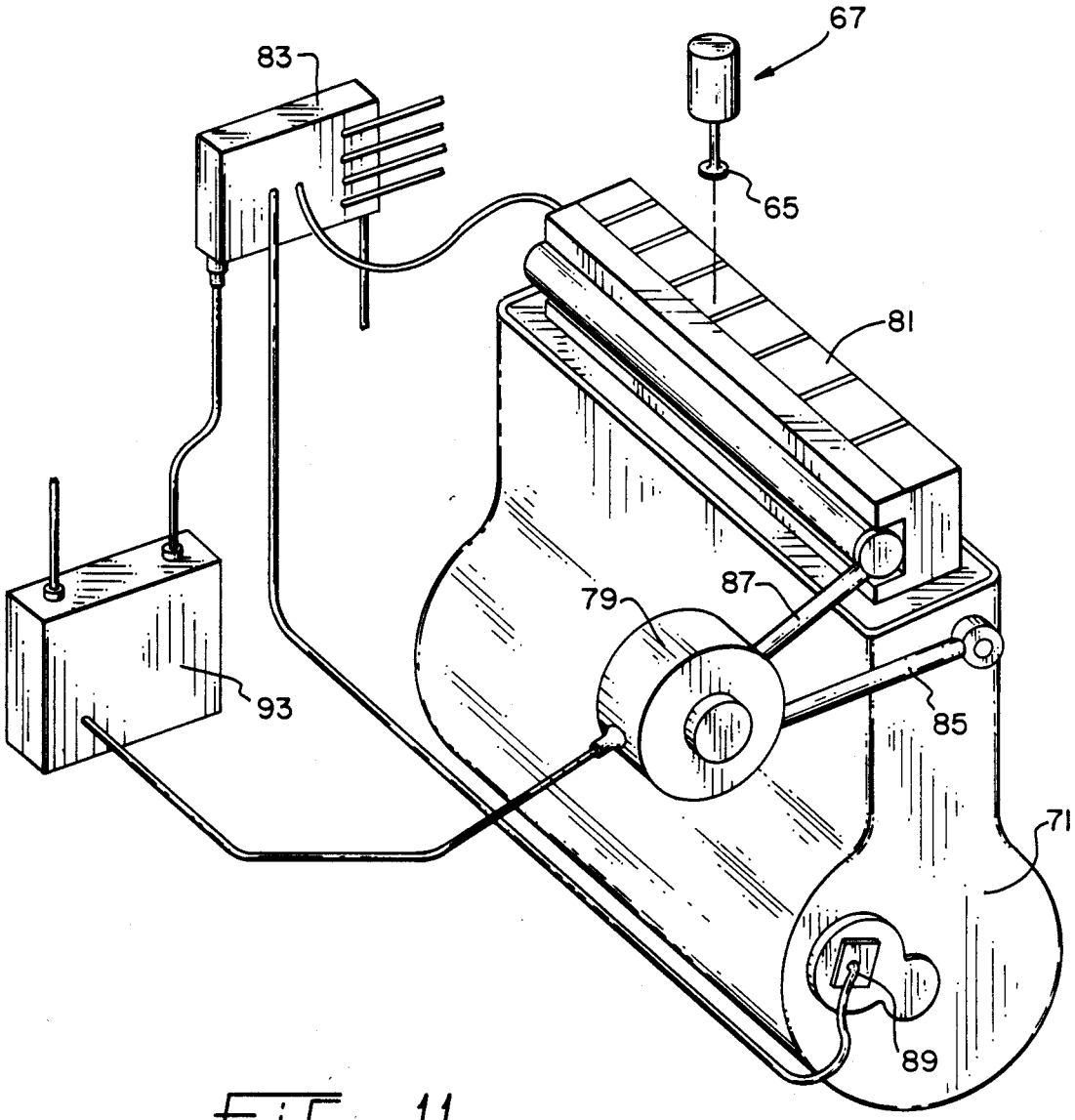
FIG. 11 is a somewhat schematic perspective view of an internal combustion engine incorporating the invention in one form.
Figure 12:
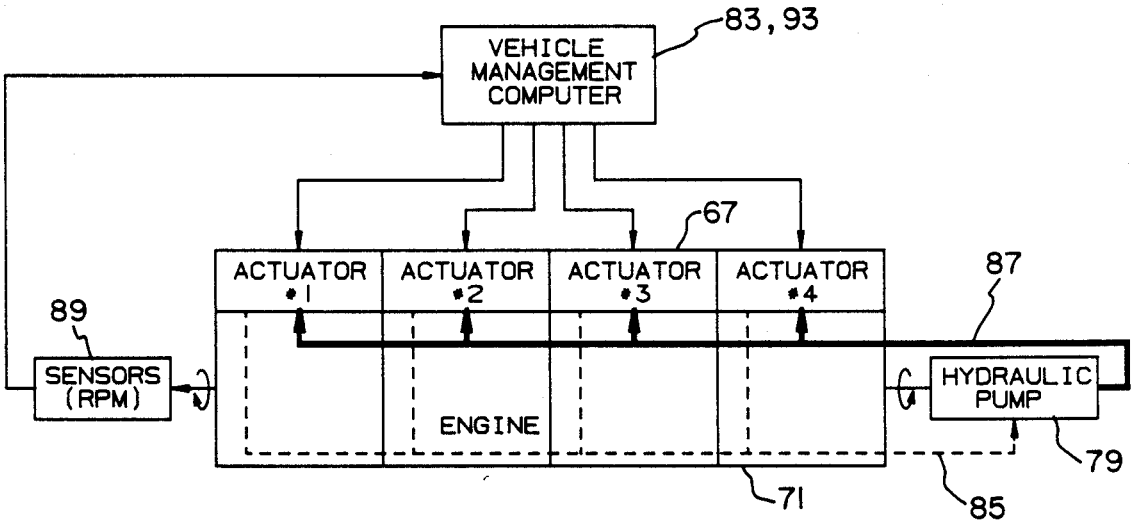
FIG. 12 is a schematic illustration of an internal combustion engine incorporating the invention in one form.

In FIG. 11, an illustrative transducer and valve 67 such as shown in FIG. 10 are depicted with an internal combustion engine 71. This drawing also shows an engine driven high pressure hydraulic pump 79 which supplies fluid to the several valve actuators within the valve cover 81, a module 83 for sensing a plurality of engine operating values, e.g., responding to an engine RPM sensor 89, and an electronic control unit 93 for selectively energizing coils such as 37 and 47 as heretofor discussed. Comparing FIGS. 11 and 12, it will be noted that the functions of the electronic control units 83 and 93 may be combined into a single vehicle management computer. FIG. 12 shows the hydraulic pump 79 supplying high pressure fluid to four individual actuators on the engine 71, however, the number of actuators may vary widely depending on the particular engine configuration. The hydraulic return 85 is shown in dotted lines in FIG. 12.

From the foregoing, it is now apparent that a novel hydraulic valve actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An electrically controlled hydraulically powered valve actuator comprising:

a valve actuator housing;

a power piston reciprocable within the housing along an axis;

a bistable hydraulic fluid control valve reciprocable along said axis relative to both the housing and the piston between first and second stable positions, movement of the control valve in one direction from one stable position to the other stable position providing hydraulic fluid to the power piston causing the power piston to move in a direction opposite said one direction;

a low volume constant pressure source of high pressure fluid comprising a cylinder with a pair of spaced apart pistons spring biased toward one another;

a remote high pressure source coupled to the space intermediate the pistons; and means including said bistable hydraulic fluid control valve for intermittently delivering high pressure fluid from the space intermediate the pistons whereby the pistons collapse toward one another due to the spring bias while maintaining the fluid pressure as fluid exits the space.

2. The electronically controlled hydraulically powered valve actuator of claim 1 further comprising means for controlling the control valve including a pair of permanent magnets and a corresponding pair of coils with each coil being energizable to at least partially neutralize the magnetic field of the associated permanent magnet.

3. The electronically controlled hydraulically powered valve actuator of claim 1 wherein the control valve comprises a cylindrical sleeve coaxial with and at least partially surrounding the piston, and an armature joined to the sleeve and responsive to magnetic fields to retain the control valve in either stable position.

4. The electronically controlled hydraulically powered valve actuator of claim 1 wherein the control valve is magnetically latched in each of its stable positions and further comprising spring means for urging the control valve away from the stable position in which it is latched.

5. The electronically controlled hydraulically powered valve actuator of claim 1 wherein the cylinder with the pair of spaced apart pistons provides a low volume, low pressure fluid sink in the expanding space left behind as the pistons collapse toward one another.

6. A hydraulically actuated transducer comprising:

a transducer housing;

a member reciprocable within the housing along an axis, said member having a pair of opposed primary working surfaces for receiving hydraulic fluid pressure for moving the member along the axis;

a high pressure hydraulic fluid source;

a bistable hydraulic fluid control valve reciprocable along said axis relative to both the housing and the reciprocable member between first and second stable positions;

means for selectively actuating the control valve to move from one stable position to the other stable position to enable the flow of high pressure hydraulic fluid to one of the primary working surfaces;

a pair of cylinders each with a pair of spaced apart pistons; the cylinders coupled to, and the pistons biased apart by, the source of high pressure hydraulic fluid; and spring means biasing the pistons toward one another.

7. The hydraulically actuated transducer of claim 6 wherein the cylinders with the pairs of spaced apart pistons each provide a constant pressure source of high pressure fluid in the space between the pistons, and a low pressure fluid sink in the expanding space left behind as the pistons collapse toward one another.

8. The hydraulically actuated transducer of claim 6 wherein movement of the control valve in one direction provides hydraulic fluid to the reciprocable member causing the member to move in a direction opposite said one direction.

9. The hydraulically actuated transducer of claim 6 further comprising a pair of permanent magnets for latching the control valve in the respective stable positions, and a corresponding pair of coils with each coil being energizable to at least partially neutralize the magnetic field of the associated permanent magnet.

10. The hydraulically actuated transducer of claim 6 wherein the control valve comprises a cylindrical sleeve coaxial with and at least partially surrounding the reciprocable member, and an armature joined to the sleeve and responsive to magnetic fields to retain the control valve in either stable position.

11. The hydraulically actuated transducer of claim 6 wherein the control valve is magnetically latched in each of its stable positions and further comprising spring means for urging the control valve away from the stable position in which it is latched.

12. The hydraulically actuated transducer of claim 11 wherein the spring means comprises at least one spring connected to the control valve and to the reciprocable member.

13. The hydraulically actuated transducer of claim 12 wherein movement of the control valve in one direction provides hydraulic fluid to the reciprocable member causing the member to move in a direction opposite said one direction.

14. The hydraulically actuated transducer of claim 13 further comprising a pair of permanent magnets for latching the control valve in the respective stable positions, the spring being prestressed by continued member motion after latching to provide a stored restorative force urging the control valve away from the stable position in which it is latched.

15. The hydraulically actuated transducer of claim 14 further comprising a pair of coils with each coil being energizable to at least partially neutralize the magnetic field of a corresponding one of the permanent magnets.

16. A hydraulically actuated transducer comprising:

a transducer housing;

a member reciprocable within the housing along an axis, said member having a pair of opposed primary working surfaces for receiving hydraulic fluid pressure for moving the member along the axis;

a bistable hydraulic fluid control valve reciprocable along said axis relative to both the housing and the reciprocable member between first and second stable positions;

a high pressure hydraulic fluid source including a variable volume chamber closely adjacent the reciprocable member and separated therefrom by the control valve, the variable volume chamber being expanded by high pressure fluid and collapsing upon the release of high pressure fluid therefrom to sustain the pressure as fluid flows into the transducer engaging a primary working surface; and means for selectively actuating the control valve to move from one stable position to the other stable position to enable the flow of high pressure hydraulic fluid to one of the primary working surfaces.

17. A hydraulically powered command triggered valve actuator for actuating an intake or exhaust valve in an internal combustion engine comprising:

a cylinder;

a power piston having a pair of opposed faces and reciprocable along an axis between first and second extreme positions within the cylinder;

a reservoir of high pressure hydraulic fluid;

a cylindrical control valve radially intermediate the reservoir and the cylinder, the control valve being movable upon command to alternately supply high pressure fluid to one face and then the other face of the power piston causing the piston to move from one extreme position to the other extreme position; and spring bias means for urging the control valve toward a position intermediate the extreme positions, the spring bias means comprising at least one spring connected to the control valve and to the power piston.

18. The hydraulically powered command triggered valve actuator of claim 17 wherein the cylindrical control valve is a shuttle valve reciprocable along the axis of the power piston between extreme positions, control valve motion along the axis in one direction being effective to supply high pressure fluid to move the piston in the opposite direction.

19. The hydraulically powered command triggered valve actuator of claim 18 wherein both the control valve and the piston are stable in both of their respective extreme positions.

* * * * *